US009145835B2

(12) United States Patent
Stolk et al.

(10) Patent No.: US 9,145,835 B2
(45) Date of Patent: Sep. 29, 2015

(54) INTERNAL COMBUSTION ENGINE VALVE DRIVE DEVICE FOR A MOTOR VEHICLE

(71) Applicant: DAIMLER AG, Stuttgart (DE)

(72) Inventors: Thomas Stolk, Kirchheim (DE); Alexander Von Gaisberg-Helfenberg, Beilstein (DE)

(73) Assignee: DAIMLER AG, Stuttgart (DE)

( * ) Notice: Subject to any disclaimer, the term of this patent is extended or adjusted under 35 U.S.C. 154(b) by 0 days.

(21) Appl. No.: 14/106,750

(22) Filed: Dec. 14, 2013

(65) Prior Publication Data

US 2014/0102389 A1 Apr. 17, 2014

Related U.S. Application Data

(63) Continuation-in-part of application No. PCT/EP2011/006300, filed on Dec. 14, 2011.

(30) Foreign Application Priority Data

Jun. 16, 2011 (DE) ..... 10 2011 104 382

(51) Int. Cl.

| | |
|---|---|
| ***F01L 1/34*** | (2006.01) |
| ***F02D 13/02*** | (2006.01) |
| ***F01L 13/00*** | (2006.01) |

(52) U.S. Cl.

CPC ..... *F02D 13/02* (2013.01); *F01L 13/0036* (2013.01); *F01L 2013/0052* (2013.01)

(58) Field of Classification Search

CPC ..... F02D 13/02; F01L 13/0036; F01L 2013/0052

USPC ..... 123/90.18, 90.16, 90.6

See application file for complete search history.

(56) References Cited

U.S. PATENT DOCUMENTS

| | | | | |
|---|---|---|---|---|
| 7,146,966 | B2 * | 12/2006 | Nakamura | 123/481 |
| 7,409,938 | B2 | 8/2008 | Dengler | |
| 8,474,424 | B2 * | 7/2013 | Meintschel et al. | 123/90.18 |
| 8,893,674 | B2 * | 11/2014 | Lengfeld et al. | 123/90.16 |
| 2005/0011480 | A1 * | 1/2005 | Schultz et al. | |
| 2007/0034182 | A1 | 2/2007 | Dengler | |
| 2011/0126786 | A1 | 6/2011 | Kidooka et al. | |

FOREIGN PATENT DOCUMENTS

| | | |
|---|---|---|
| DE | 10 2004 022 301 | 12/2005 |
| DE | 10 2004 022 849 | 12/2005 |
| DE | 10 2005 033 018 | 1/2007 |
| DE | 10 2007 010 149 | 9/2008 |

(Continued)

*Primary Examiner* — Ching Chang

(74) *Attorney, Agent, or Firm* — Klaus J. Bach

(57) ABSTRACT

In an internal combustion engine valve drive device having at least one switch gate for valve lift switching by converting a rotation of at least a first and a second cam element into an axial movement by first and second actuators provided for axially displacing the first cam element and the second cam element in a first switching direction via an operative connection of the first actuator with the switch gate and the second actuator provided for axially displacing the second cam element in the same switching direction via an operative connection with the switch gate, the device including a control unit controlling the axial displacement of the first and second cam elements in the same switching direction under the control unit by actuating the first and second actuators at the same time.

10 Claims, 1 Drawing Sheet

(56) References Cited

FOREIGN PATENT DOCUMENTS

| | | |
|---|---|---|
| DE | 10 2007 010 156 | 9/2008 |
| DE | 10 2008 024 876 | 11/2009 |
| DE | 10 2008 028 513 | 12/2009 |
| DE | 10 2009 006 632 | 8/2010 |
| EP | 1 503 048 | 2/2005 |
| JP | 2006 520869 | 9/2006 |
| JP | 2009 144582 | 7/2009 |
| WO | WO 2004/083611 | 9/2004 |

* cited by examiner

INTERNAL COMBUSTION ENGINE VALVE DRIVE DEVICE FOR A MOTOR VEHICLE

This is a Continuation-In-Part application of pending international patent application PCT/EP2011/006300 filed Dec. 14, 2011 and claiming the priority of German patent application 10 2011 104 382.2 filed Jun. 16, 2011.

BACKGROUND OF THE INVENTION

The invention relates to an internal combustion engine valve drive device which has at least one switch gate for axially displacing cam elements so as to provide for operation of the engine valves with different lift cams.

DE 10 2009 006 632 A1 discloses an internal combustion engine valve drive device for a motor vehicle with at least one switch gate which, for valve lift switching, is adapted to convert rotary motion of at least one cam element into an axial motion of the at least one cam element. The device has at least one actuator which is provided for axially displacing a first cam element in a switching direction via an operative connection with the switch gate, and a second actuator which is provided for axially displacing the cam element in an opposite switching direction via an operative connection with the switch gate. A control unit for controlling the switching operation is also provided.

It is the object of the present invention in particular to reduce costs of the internal combustion engine valve drive device.

SUMMARY OF THE INVENTION

In an internal combustion engine valve drive device having al least one switch gate for valve lift switching by converting a rotation of at least a first and a second cam element into an axial movement by first and second actuators provided for axially displacing the first cam element and the second cam element in a first switching direction via an operative connection of the first actuator with the switch gate and the second actuator provided for axially displacing the second cam, element in the same switching direction via an operative connection with the switch gate, the device includes a control unit controlling the axial displacement of the first and second cam elements successively in the same switching direction under the control unit while actuating the first and second actuators at the same time.

For axially displacing the at least two cam elements in the same switching direction, the control unit is provided for simultaneously controlling and/or monitoring the at least two actuators. En this way, particularly advantageous control and/or monitoring of all actuators which are provided for axially displacing the cam elements in the same switching direction, i.e., at least the first actuator and the second actuator, may be achieved, so that all actuators for initializing a switching direction may be simultaneously controlled and/or monitored, and therefore coding of the switching of the cam, elements may be achieved. As a result, in the event of failure of one actuator, all actuators are deactivated, so that either all cam elements or none of the cam elements are axially displaced, and thus, only corresponding operating states may be ensured. An incorrect and/or incomplete axial displacement of the cam elements, and thus incorrect and/or incomplete lift switching, can be avoided.

The control unit is preferably provided for simultaneously controlling and/or monitoring all actuators which are provided for the same switching direction. Due to simultaneously controlling all actuators which are provided for the same switching direction, the control provided for controlling and/or monitoring the actuators is also simplified, so that in particular the number of control and/or output stages or outputs of the control unit are reduced. As a result, costs of the internal combustion engine valve drive device are reduced, and therefore a reliable and economical internal combustion engine valve drive device is provided. In principle, the internal combustion engine valve drive device may have, in addition to the first actuator and the second actuator, further actuators which are provided for the same switching direction, each of which is provided for axially displacing a further cam element, in addition to the first can element and the second cam element, in the switching direction which corresponds to the switching direction provided by the first actuator and the second actuator, via an operative connection with the switch gate. In the present context. "all actuators" is understood to mean in particular all actuators, i.e., at least the first actuator and the second actuator, which are associated with the same camshaft, for example an exhaust camshaft or an intake camshaft, for displacement in at least one switching direction, and thus, all actuators which are provided on the same camshaft for lift switching in a particular switching direction.

A "switch gate" is understood to mean a switching unit for axially displacing at least one cam element, which has at least one gate track that is provided for converting a rotary motion into an axial adjusting movement. A "gate track" is understood in particular to mean a track for forced guidance arranged on at least one side, preferably on both sides, of a switching element, in particular a switch pin. The gate track is preferably in the form of a web, or in the form of a slot, or in the form of a groove. The switching element is preferably in the form of a shifting shoe which surrounds the web, in the form of a pin which engages in the slot, or in the form of a pin which is guided in the groove.

The term "lift switching" is understood in particular to mean a discrete switch between at least two valve actuation cams which provide for an actuation of a gas exchange valve of an internal combustion engine having the internal combustion engine valve drive device. A "rotary motion and/or axial motion" is understood in particular to mean a rotary motion and/or axial motion with regard to a rotational axis of the camshaft. A "cam element" is understood in particular to mean an element which has at least one cam for actuating at least one gas exchange valve of the internal combustion engine and which forms the at least one valve actuation curve. An "operative connection" is understood in particular to mean a positive-fit operative connection by means of which the rotary motion is converted into the axial motion. A "switching direction" is understood in particular to mean an axial direction of motion of a cam element with respect to the rotational axis of the camshaft, the lift switching occurring due to a movement of the cam element in the direction of motion and being defined by the operative connection of the actuator with the switch gate, in particular with the corresponding gate track of the switch gate. A "control unit" is understood in particular to mean a unit having at least one control device. A "control device" is understood in particular to mean a unit having a processor unit and a memory unit as well as an operating program that is stored in the memory unit. In principle, the control unit may have multiple interconnected control devices which preferably are provided for communicating with one another via a bus system, such as a CAN bus system in particular. The term "the same switching direction" is understood in particular to mean an axial direction of motion of the at least two cam elements in the same direction, in the sense that the valve actuation curves are switched from a first operating mode, for example a high load of the internal combustion engine, to a second operating mode, for example a low load of the internal combustion engine, wherein for error-free and/or complete axial displacement, and thus for error-free and/or complete lift switching, all cam elements must be displaced in the same or opposite axial direction of motion, in particular sequentially. In the present context, the term "all cam elements" is understood in particular to mean all cam elements, i.e., at least the first cam element and the second cam element, that are associated with the same camshaft, for example an exhaust camshaft or an intake camshaft, and thus, all cam elements that are provided for the lift switching on the same camshaft. The term "provided" is understood in particular to mean specially programmed, designed, equipped, and/or situated.

It is further proposed that at least the first actuator and the second actuator are electrically connected to one another in parallel or in series. Simultaneous control and/or monitoring may thus be achieved in a particularly simple manner.

In one advantageous embodiment, the control unit has a control and/or output stage which is simultaneously connected to the at least two actuators, which are provided for axially displacing the at least two cam elements in the same switching direction, as the result of which costs may be reduced in a particularly simple manner. An "output stage" is understood in particular to mean a unit on the output side via which at least one actuator is controlled and/or monitored and/or which is provided for supplying the at least one actuator with sufficient power for the control and in particular for amplifying an output signal for the at least one actuator which is output by a microprocessor (CPU). A control stage is understood in particular to mean a unit that is connected upstream from one or more output stages.

It is further proposed that, for axially displacing the at least two cam elements, the control unit is provided for simultaneously controlling and/or monitoring, regardless of a switching direction of the actuators, the at least two actuators and at least one third actuator, which is provided for axially displacing the first cam element and/or the second cam element in a switching direction oriented opposite the switching direction provided by the first actuator and the second actuator, via an operative connection with the switch gate. Particularly advantageous control and/or monitoring of all actuators, which are provided for the two opposite switching directions, may thus be achieved. The term "regardless of a switching direction" is understood in particular to mean that all actuators, no matter which switching direction they are provided for, are controlled and/or monitored, and/or, no matter in which switching direction the cam elements are to be displaced, all actuators, and thus at least the first actuator, the second actuator, and the third actuator, are controlled and/or monitored. The term "switching direction provided by an actuator" is understood in particular to mean a switching direction that results due to the operative connection of the actuator with the switch gate.

It is further proposed that at least the third actuator is electrically connected in parallel or in series with the first actuator and the second actuator, and is provided for axially displacing the first cam element and/or the second cam element in a switching direction oriented opposite the switching direction provided by the first actuator and the second actuator, via an operative connection with the switch gate. In this way, all actuators which are provided for axially displacing all cam elements in both opposite switching directions may easily be simultaneously controlled and/or monitored, so that costs may further reduced. In principle, the internal combustion engine valve train device may have, in addition to the third actuator, further actuators which are provided for the same switching direction, and which are each provided for axially displacing a further cam element in the switching direction opposite the switching direction provided by the first actuator and the second actuator, via an operative connection with the switch gate.

In particular, it is advantageous for the control and/or output stage to be simultaneously connected to the at least three actuators which are provided for axially displacing the at least two cam elements in the two opposite switching directions. Costs may thus be further reduced in a particularly simple manner.

In one alternative embodiment according to the invention, the internal combustion engine valve train device has at least one third actuator which is connected electrically separate from the first actuator and the second actuator, and is provided for axially displacing the first cam element and/or the second cam element in a switching direction oriented opposite the switching direction provided by the first actuator and the second actuator, via an operative connection with the switch gate. A particularly advantageous internal combustion engine valve train device may thus be provided in which only the actuators which are provided for axially displacing the cam elements in the same switching direction are jointly controlled and/or monitored, i.e., in which the simultaneous control and/or monitoring of the actuators occurs for each switching direction. The term "electrically separate" is understood in particular to mean that at least the third actuator is controlled and/or monitored independently from the first actuator and the second actuator, and is controlled and monitored individually.

It is advantageous for the control and/or output stage to be simultaneously connected only to at least the first actuator and the second actuator, and thus only to the actuators that are provided for the same switching direction, so that only a single control and/or output stage, in particular a single output stage for each switching direction, is required, in particular regardless of the number of actuators, and thus regardless of the number of cam elements.

In particular, it is advantageous when the internal combustion engine valve train device has at least one fourth actuator which is electrically connected in parallel or in series with the third actuator, and which is provided for axially displacing the first cam element or the second cam element in the switching direction which corresponds to the switching direction provided by the third actuator, via an operative connection with the switch gate. At least the first cam element and the second cam element may thus be axially displaced in the two switching directions in a particularly advantageous manner.

It is also advantageous when the control unit has a further control and/or output stage which is connected at least to the third actuator. Particularly advantageous control and/or monitoring of the actuators may thus be achieved in which all actuators having the same switching direction are simultaneously controlled and/or monitored, but independently of all actuators having the opposite switching direction. The further control and/or output stage is preferably simultaneously connected to all actuators which are provided for providing a switching direction that corresponds to the switching direction provided by the third actuator, and is therefore simultaneously connected at least to the third actuator and the fourth actuator.

In addition, a method for lift switching in an internal combustion engine of a motor vehicle by means of an internal combustion engine valve drive device, in particular an internal combustion engine valve drive device according to the invention, is proposed in which a first cam element is axially displaced in a switching direction by means of an operative connection of a first actuator with a switch gate, and a second cam element is axially displaced in the same switching direction by means of an operative connection of a second actuator with the switch gate, at least the first actuator and the second actuator being simultaneously controlled for axially displacing the at least two cam elements. In this way, all actuators which are provided for axially displacing all cam elements in the same switching direction, i.e., at least the first actuator and the second actuator, and thus all actuators for initializing a switching direction, may be simultaneously controlled and/or monitored in a particularly advantageous manner by means of only one control and/or output stage, in particular by means of only one output stage, so that costs of the internal combustion engine valve train device may be reduced.

Below, two exemplary embodiments of the invention are illustrated with reference to the accompanying drawings. The drawings, the description, and the claims contain numerous features in combination. Those skilled in the art will also advantageously consider the features individually and combine them into further meaningful combinations.

DESCRIPTION OF EXEMPLARY EMBODIMENTS

Figure 1:
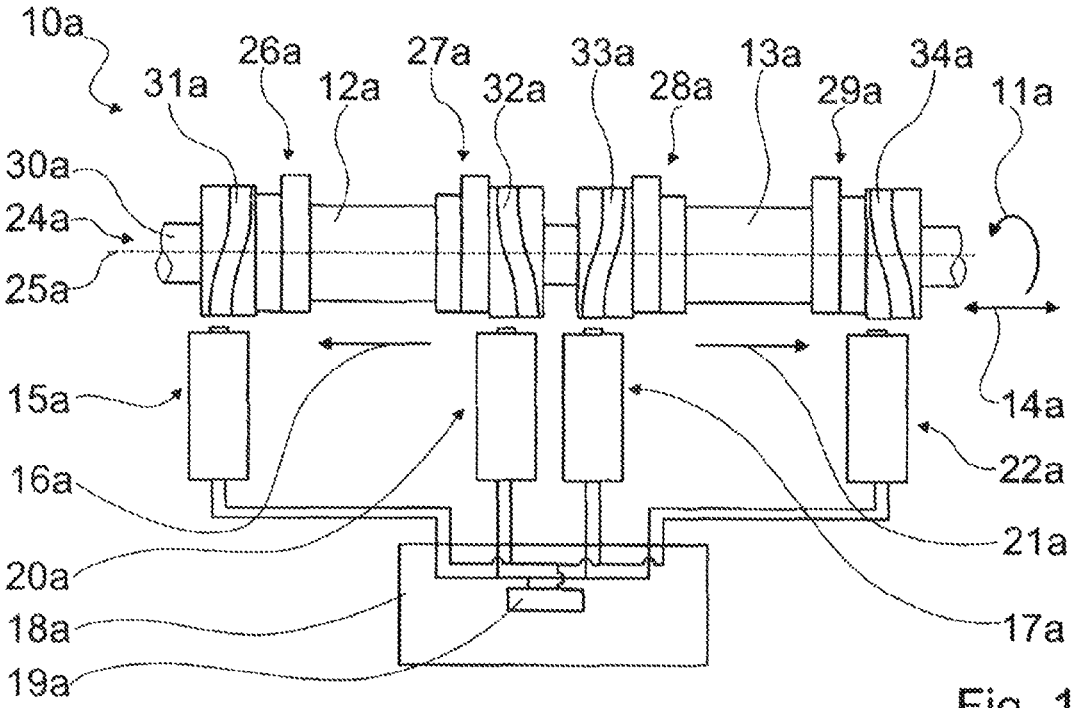
FIG. 1 shows an internal combustion engine valve drive device having four actuators electrically connected in parallel.

FIG. 1 schematically shows an internal combustion engine valve drive device for a motor vehicle. The internal combustion engine valve drive device has a camshaft 24*a* for actuating gas exchange valves of the internal combustion engine. The camshaft 24*a* is an intake camshaft. The internal combustion engine valve drive device has further an exhaust camshaft, not illustrated, which in principle may be controlled or monitored analogously to the intake camshaft 24*a*. In principle, the internal combustion engine valve drive device may have further camshafts which are analogously controlled or monitored.

The camshaft 24*a* has two axially displaceable cam elements 12*a*, 13*a*. The cam elements 12*a*, 13*a* are displaceable along a rotational axis 25*a* of the camshaft 24*a*. The cam elements 12*a*, 13*a* are each designed as a cam support. Two cams 26*a*, 27*a* are situated on the cam element 12*a* and two cams 28*a*, 29*a* are situated on the cam element 13*a*, the cams in each case having two partial cams with different valve actuation curves. The partial cams of each of the cams 26*a*, 27*a*, 28*a*, 29*a* are in each case situated directly adjacent to one another. A switch is made within the cam 26*a*, 27*a*, 28*a*, 29*a* from one partial cam to the other partial cam by an axial displacement of the respective cam elements 12*a*, 13*a*. Each of the cam elements 12*a*, 13*a* thus has two discrete switching positions in which a different valve lift is switched for one or more cylinders associated with the corresponding cam element 12*a*, 13*a*. The cams 26*a*, 27*a*, 28*a*, 29*a* may be designed in one piece with the respective cam element 12*a*, 13*a*, or may be situated thereon in a nondisplaceable and rotationally fixed manner. In principle, the camshaft 24*a* may also have further cam elements having at least one cam.

The camshaft 24*a* includes a drive shaft 30*a* for supporting the cam elements 12*a*, 13*a*. The drive shaft 30*a* includes a crankshaft connection for connection to a crankshaft, not illustrated in greater detail, of the internal combustion engine. The crankshaft connection may be formed by means of a camshaft adjuster which is provided for setting a phase position between the camshaft 24*a* and the crankshaft of the engine.

The cam elements 12*a*, 13*a* are axially displaceable and disposed on the drive shaft 30*a* in a rotationally fixed manner. The drive shaft 30*a* has spur toothing on its outer periphery. The cam elements 12*a*, 13*a* have corresponding spur toothing on their inner periphery which engages with the spur toothing of the drive shaft 30*a*.

For the lift switching, the internal combustion engine valve drive device has a switch gate 10*a* which is provided for converting a rotary motion 11*a* of the cam elements 12*a*, 13*a* into an axial motion 14*a* of the cam elements 12*a*, 13*a*. The switch gate 10*a* is provided for sequentially axially displacing the two cam elements 12*a*, 13*a* one after the other in a switching operation. The switch gate 10*a* includes four gate tracks 31*a*, 32*a*, 33*a*, 34*a* for displacing the cam elements 12*a*, 13*a* in two mutually opposite switching directions 16*a*, 21*a*. The gate tracks 31*a*, 32*a*, 33*a*, 34*a* each extend around a cam element 12*a*, 13*a*, and thus, about the rotational axis 25*a*. The gate tracks 31*a*, 32*a* are associated with the first cam element 12*a*, and are situated on the first cam element 12*a*. The gate tracks 33*a*, 34*a* are associated with the second cam element 13*a*, and are situated on the second cam element 13*a*. The gate tracks 31*a*, 33*a* have an identical design with respect to the associated cam element 12*a*, 13*a*, and the gate tracks 32*a*, 34*a* have an identical design with respect to the associated cam element 12*a*, 13*a*. The gate track 31*a* is provided for axially displacing the first cam element 12*a* in the switching direction 16*a*, and the gate track 33*a* is provided for axially displacing the second cam element 13*a* in the same switching direction 16*a*. The gate tracks 31*a*, 33*a* are provided for the switching direction 16*a*. The gate track 32*a* is provided for axially displacing the first cam element 12*a* in the switching direction 21*a*, and the gate track 34*a* is provided for axially displacing the second cam element 13*a* in the same switching direction 21*a*. The gate tracks 32*a*, 34*a* are provided for the switching direction 21*a*.

The internal combustion engine valve drive device has four actuators 15*a*, 17*a*, 20*a*, 22*a* for axially displacing the cam elements 12*a*, 13*a* in both switching directions 16*a*, 21*a* and for actuating the cam elements 12*a*, 13*a*. The actuators 15*a*, 17*a* are provided for the same switching direction 16*a*, and are referred to below as the first actuator 15*a* and the second actuator 17*a*. These actuators provide the same switching direction 16*a*. The first actuator 15*a* is provided for axially displacing the first cam element 12*a* in the switching direction 16*a* via an operative connection with the gate track 31*a* of the switch gate 10*a*. The second actuator 17*a* is provided for axially displacing the second cam element 13*a* in the same switching direction 16*a* via an operative connection with the gate track 33*a* of the switch gate 10*a*.

The actuators 20*a*, 22*a* are provided for the same switching direction 21*a*, which extends opposite the switching direction 16*a*, and are referred to below as the third actuator 20*a* and the fourth actuator 22*a*. These actuators provide the same switching direction 21*a*, which is opposite the switching direction 16*a* provided by the first actuator 15*a* and the second actuator 17*a*. The third actuator 20*a* is provided for axially displacing the first cam element 12*a* in the switching direction 21*a* via an operative connection with the gate track 32*a* of the switch gate 10*a*. The fourth actuator 22*a* is provided for axially displacing the second cam element 13*a* in the same switching direction 21*a* via an operative connection with the gate track 34*a* of the switch gate 10*a*.

Each of the four actuators 15*a*, 17*a*, 20*a*, 22*a* has a switch pin for the operative connection with the switch gate 10*a*. For establishing the operative connection, the switch pins of the actuators 15*a*, 17*a*, 20*a*, 22*a* are each brought into engagement with the corresponding gate track 31*a*, 32*a*, 33*a*, 34*a*. The actuators 15*a*, 17*a*, 20*a*, 22*a* each have a stator housing which is fixedly connected to an engine block, not illustrated in greater detail, of the internal combustion engine. The switch pins are each situated in the corresponding stator housing so as to be displaceable along their main direction of extension. For actuating and thus extending the switch pins, each of the four actuators 15*a*, 17*a*, 20*a*, 22*a* has a coil which is energized to generate a magnetic field, thus moving the corresponding switch pin from the stator housing.

The gate tracks 31*a*, 32*a*, 33*a*, 34*a* are each designed as a groove in which the corresponding switch pin is be forcibly guided on both sides. For an axial displacement of the first cam element 12*a* in the switching direction 16*a*, the switch pin of the first actuator 15*a* is brought into engagement with the gate track 31*a* of the switch gate 10*a*. The actuator 15*a* provides the switching direction 16*a* due to the engagement of its switch pin with the gate track 31*a*, and thus via an operative connection with the switch gate 10*a*. For an axial displacement of the second cam element 13*a* in the switching direction 16*a*, the switch pin of the second actuator 17*a* is brought into engagement with the gate track 33*a* of the switch gate 10*a*. The actuator 17*a* provides the switching direction 16*a* due to the engagement of its switch pin with the gate track 33*a*, and thus via an operative connection with the switch gate 10*a*. For an axial displacement of the first cam element 12*a* in the switching direction 21*a*, the switch pin of the third actuator 20*a* is brought into engagement with the gate track 32*a* of the switch gate 10*a*. The actuator 20*a* provides the switching direction 21*a* due to the engagement of its switch pin with the gate track 32*a*, and thus via an operative connection with the switch gate 10*a*. For an axial displacement of the second cam element 13*a* in the switching direction 21*a*, the switch pin of the fourth actuator 22*a* is brought into engagement with the gate track 34*a* of the switch gate 10*a*. The actuator 22*a* provides the switching direction 21*a* due to the engagement of its switch pin with the gate track 34*a*, and thus via an operative connection with the switch gate 10*a*.

In the present exemplary embodiment, all four actuators 15*a*, 17*a*, 20*a*, 22*a* are electrically connected to one another in parallel. The actuators 15*a*, 17*a*, 20*a*, 22*a* are electrically connected to one another in parallel, regardless of which switching direction 16*a*, 21*a* they are provided for. The actuators 15*a*, 17*a*, 20*a*, 22*a* are controllable only jointly and simultaneously. The coils of the actuators 15*a*, 17*a*, 20*a*, 22*a* are connected to one another in parallel and are therefore energized in parallel and thus simultaneously. As a result, all switch pins are simultaneously extended, regardless of the switching direction 16*a*, 21*a* to be switched, whereby the switch pins which are provided for the wrong switching direction 16*a*, 21*a* are each pushed back into the corresponding stator housing by an ejection ramp of the particular gate track 31*a*, 32*a*, 33*a*, 34*a*.

The internal combustion engine valve train device has a control unit 18*a* for controlling and monitoring the four actuators 15*a*, 17*a*, 20*a*, 22*a*. The control unit 18*a* simultaneously controls and monitors all four actuators 15*a*, 17*a*, 20*a*, 22*a* for axially displacing the two cam elements 12*a*, 13*a* in the switching direction 16*a* and in the switching direction 21*a*. The control unit 18*a* simultaneously controls and monitors all actuators 15*a*, 17*a*, 20*a*, 22*a* for axially displacing the two cam elements 12*a*, 13*a*, regardless of the switching direction 16*a*, 21*a*. The control unit 18*a* simultaneously energizes all coils of the actuators 15*a*, 17*a*, 20*a*, 22*a* for controlling, and thus for actuating, the actuators 15*a*, 17*a*, 20*a*, 22*a*, so that all switch pins are simultaneously extended regardless of the switching direction 16*a*, 21*a*. In principle, the control unit 18*a* may also only control or only monitor the actuators 15*a*, 17*a*, 20*a*, 22*a*.

Due to the simultaneous monitoring of all four actuators 15*a*, 17*a*, 20*a*, 22*a*, the control unit 18*a* detects a defective or nonfunctional actuator 15*a*, 17*a*, 20*a*, 22*a*, for example a defective or disconnected electrical connection to the actuators 15*a*, 17*a*, 20*a*, 22*a*, as the result of which the control unit 18*a* deactivates all actuators 15*a*, 17*a*, 20*a*, 22*a* and thus prevents an undefined mixed state of the cam elements 12*a*, 13*a*. The control and regulation unit 18*a* deactivates the actuators 15*a*, 17*a*, 20*a*, 22*a*, for example by deactivating energization of the coils of the actuators 15*a*, 17*a*, 20*a*, 22*a*. In principle, the control and regulation unit 18*a* may be provided for outputting an error message, for example by actuating a visual, acoustic, and/or haptic warning element in a motor vehicle interior, when a defective or nonfunctional actuator 15*a*, 17*a*, 20*a*, 22*a* is detected.

The control unit 18*a* has only one output stage 19*a* for controlling and monitoring all actuators 15*a*, 17*a*, 20*a*, 22*a*. The output stage 19*a* is simultaneously connected to the four actuators 15*a*, 17*a*, 20*a*, 22*a*, which are provided for axially displacing the two cam elements 12*a*, 13*a* in both switching directions 16*a*, 21*a*. The output stage 19 is thus simultaneously connected to the two actuators 15*a*, 17*a*, which are provided for axially displacing the two cam elements 12*a*, 13*a* in the switching direction 16*a*, as well as to the two actuators 20*a*, 22*a*, which are provided for axially displacing the two cam elements 12*a*, 13*a* in the opposite switching direction 21*a*. In principle, the output stage 19*a* may also be designed as a control stage.

In an operating state in which the cam elements 12*a*, 13*a* are to be axially displaced for lift switching in the switching direction 16*a*, the control unit 18*a* controls the actuators 15*a*, 17*a*, 20*a*, 22*a*, which are connected in parallel, and thus simultaneously controls the actuators 15*a*, 17*a* which are provided for the desired switching direction 16*a*, and the actuators 20*a*, 22*a*, which are provided for the opposite switching direction 21*a*, so that the coils of all actuator 15*a*, 17*a*, 20*a*, 22*a*, are simultaneously energized and therefore the switch pins are simultaneously extended by each actuator 15*a*, 17*a*, 20*a*, 22*a*. The switch pins of the actuators 15*a*, 17*a*, which are associated with the correct switching direction 16*a*, simultaneously engage with the corresponding gate track 31*a*, 33*a*, so that the actuator 15*a* and the actuator 17*a* are in operative connection with the switch gate 10*a*, and the cam elements 12*a*, 13*a* are sequentially axially displaced in the switching direction 16*a* due to the rotary motion 11*a* of the camshaft 24*a*. The switch pins of the actuators 20*a*, 22*a*, which are associated with the opposite switching direction 21*a*, are immediately pushed back into the corresponding stator housing of the actuator 20*a*, 22 by the ejection ramp of the respective gate track 32*a*, 34*a* without having caused an axial displacement of the cam elements 12*a*, 13*a*, so that the actuators 20*a*, 22*a* remain deactivated. If an electrical connection between an actuator 15*a*, 17*a*, 20*a*, 22*a* is defective or disconnected, and therefore the circuit between one of the actuators 15*a*, 17*a*, 20*a*, 22*a* is interrupted, the control unit 18*a* detects a defective actuator 15*a*, 17*a*, 20*a*, 22*a* and deactivates the remaining actuators 15*a*, 17*a*, 20*a*, 22*a*. The axial displacement, and therefore the lift switching, is interrupted or stopped in the switching direction 16*a*, thus preventing incomplete axial displacement of the cam elements 12*a*, 13*a* and allowing a defined state to be associated with the cam elements 12*a*, 13*a*, and thus with the internal combustion engine. The same analogously applies for an operating state in which the cam elements 12*a*, 13*a* are to be axially displaced for lift switching in the switching direction 21*a*.

In principle, it is possible for only the actuators 15*a*, 17*a*, 20*a*, 22*a* which are provided for providing the same switching direction 16*a*, 21*a* to be connected to one another in parallel. With reference to the above-described exemplary embodiment, the first actuator 15*a* and the second actuator 17*a*, which are both provided for axially displacing the two cam elements 12*a*, 13*a* in the same switching direction 16*a*, would then be connected to one another in parallel, and the third actuator 20*a* and the fourth actuator 22*a*, which are both provided for axially displacing the two cam elements 12*a*, 13*a* in the same switching direction 21*a* opposite the switching direction 21*a* would then be connected to one another in parallel. The actuators 15*a*, 17*a* are connected electrically separate from the actuators 20*a*, 22*a*. The actuators 15*a*, 17*a* are electrically connected, independently of the actuators 20*a*, 22*a*. The coils of the actuators 15*a*, 17*a* are connected to one another in parallel, and the coils of the actuators 20*a*, 22*a* are connected to one another in parallel. For axially displacing the cam elements 12*a*, 13*a* in the switching direction 16*a*, the control unit 18*a* controls and monitors the actuators 15*a*, 17*a*, and for axially displacing the cam elements 12*a*, 13*a* in the switching direction 21*a*, simultaneously controls and monitors the actuators 20*a*, 22*a*. The control unit simultaneously controls either the actuators 15*a*, 17*a* or the actuators 20*a*, 22*a*, for the respective switching direction 16*a*, or 21*a*. For this purpose, the control unit 18*a* has an output stage which is simultaneously connected to the first actuator 15*a* and the second actuator 17*a*, and has an output stage which is simultaneously connected to the third actuator 20*a* and the fourth actuator 22*a*. The control 18*a* thus has an output stage for each switching direction 16*a*, 21*a*.

Figure 2:
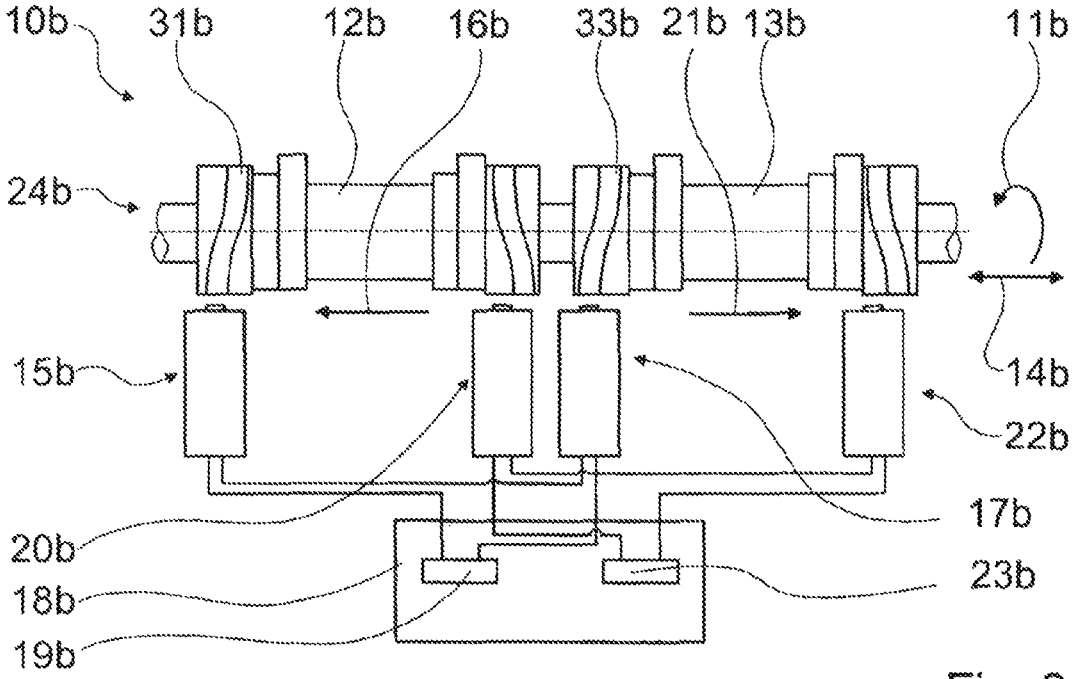
FIG. 2 shows an internal combustion engine valve drive device having four actuators of which in each case two actuators are electrically connected to one another in series.

Another exemplary embodiment of the invention is shown in FIG. 2. The following description is essentially limited to the differences between the exemplary embodiments, whereby reference may be made to the description of the other exemplary embodiment, in particular FIG. 1, with regard to components, features, and functions which remain the same. For distinguishing the exemplary embodiments, the letter "a" in the reference numerals of the exemplary embodiment in FIG. 1 is replaced by the letter "b" in the reference numerals of the exemplary embodiment in FIG. 2. Basically, reference may be also made to the drawing and/or the description of the exemplary embodiment in FIG. 1 with regard to components denoted in the same way, in particular with regard to components having the same reference numerals.

An alternative design of an internal combustion engine valve train device of a motor vehicle is illustrated in FIG. 2, showing a switch gate 10*b* which for lift switching is provided to convert a rotary motion 11*b* of two cam elements 12*b*, 13*b* into an axial motion 14*b* of the cam elements 12*b*, 13*b*. In contrast to the preceding exemplary embodiment, the internal combustion engine valve drive device has four actuators 15*b*, 17*b*, 20*b*, 22*b*, which for each switching direction 16*b*, 21*b* are electrically connected to one another in series.

The actuators 15*b*, 17*b*, which are provided for providing the same switching direction 16*b*, are electrically connected to one another in series, and the actuators 20*b*, 22*b*, which are provided for providing the opposite switching direction 21*b*, are likewise electrically connected to one another in series. Thus, the first actuator 15*b* and the second actuator 17*b*, which are each provided for axially displacing a cam element 12*b*, 13*b* in the switching direction 16*b*, are electrically connected to one another in series. In addition, the third actuator 20*b* and the fourth actuator 22*b*, which are each provided for axially displacing a cam element 12*b*, 13*b* in the switching direction 21*b*, are electrically connected to one another in series.

The third actuator 20*b* and the fourth actuator 22*b* are electrically connected separate from the first actuator 15*b* and the second actuator 17*b*. The third actuator 20*b* and the fourth actuator 22*b*, which are electrically connected independently from the first actuator 5*b* and the second actuator 17*b*, are provided for axially displacing, via an operative connection with the switch gate 10*b*, the first cam element 12*b* and the second cam element 13*b* in the same switching direction 21*b*, the switching direction 21*b* being oriented opposite the switching direction 16*b* provided by the first actuator 15*b* and the second actuator 17*b*. A circuit for controlling the actuators 15*b*, 17*b* connected in series and the actuators 20*b*, 22*b* connected in series is closed only when all electrical connections between the actuators 15*b*, 17*b* or the actuators 20*b*, 22*b* and the control unit 18*b* are functional. Thus, controlling the actuators 15*b*, 17*b* or the actuators 20*b*, 22*b* is possible only when all electrical connections between the actuators 15*b*, 7*b* or the actuators 20*b*, 22*b* and the control and regulation unit 18*b* are functional. Controlling only one actuator 15*b*, 17*b* of the two actuators 15*b*, 7*b*, or only one actuator 20*b*, 22*b* of the two actuators 20*b*, 22*b*, is not possible. The actuators 15*b*, 17*b* or the actuators 20*b*, 22*b* connected in series may only be controlled jointly, or not at all.

The internal combustion engine valve drive device has a control unit 18*b* for simultaneously controlling the actuators 15*b*, 17*b*, 20*b*, 22*b* as a function of the switching direction 16*b*, 21*b*. The control and regulation unit 18*b* simultaneously controls either the first actuator 15*b* and the second actuator 17*b* or the third actuator 20*b* and the fourth actuator 22*b*, depending on the switching direction 16*b*, 21*b* to be switched. For axially displacing the two cam elements 12*b*, 13*b* in the switching direction 16*b*, the control unit 18*b* simultaneously controls only the actuators 15*b*, 17*b*, which are provided for providing the switching direction 16*b*. For axially displacing the two cam elements 12*b*, 13*b* in the switching direction 21*b*, the control unit 18*b* simultaneously controls only the actuators 20*b*, 22*b*, which are provided for providing the switching direction 21*b*. Thus, the control and regulation unit simultaneously controls only the actuators 15*b*, 17*b*, 20*b*, 22*b* which are provided for providing the desired switching direction 16*b*, 21*b*.

Due to the electrical connection of the actuators 15*b*, 17*b* in series and the electrical connection of the actuators 20*b*, 22*b* in series, when there is a defective or nonfunctional actuator 15*b*, 17*b*, 20*b*, 22*b*, for example in the event of a defective or disconnected electrical connection, a circuit through the actuators 15*b*, 17*b* connected in series or through the actuators 20*b*, 22*b* connected in series is interrupted, thus deactivating the corresponding two actuators 15*b*, 17*b*, 20*b*, 22*b* connected in series. In principle, the control unit 18*b* may additionally or alternatively monitor the actuators 15*b*, 17*b*, 20*b*, 22*b*, so that when a defective or nonfunctional actuator 15*b*, 17*b*, 20*b*, 22*b* is detected, all other actuators 15*b*, 17*b*, 20*b*, 22*b* are deactivated and a warning message is optionally provided.

The control unit 18*a* has two output stages 19*b* and 23*b* for controlling and monitoring all actuators 15*b*, 17*b*, 20*b*, 22*b*. The control unit has only one output stage 19*b*, 23*b* for each switching direction 16*b*, 21*b*, respectively. The output stage 19*b* is simultaneously connected to the first actuator 15*b* and the second actuator 17*b*, which are provided for axially displacing the two cam elements 12*b*, 13*b* in the same switching direction 16*b*. The output stage 23*b* is simultaneously connected to the third actuator 20*b* and the fourth actuator 22*b*, which are provided for axially displacing the two cam elements 12*b*, 13*b* in the same switching direction 21*b*.

In an operating state in which the cam elements 12*b*, 13*b* are to be axially displaced for lift switching in the switching direction 16*b*, the control unit 18*b* simultaneously activates only the actuators 15*b*, 17*b* connected in series. The control unit thus simultaneously controls only the actuators 15*b*, 17*b* which are provided for the desired switching direction 16*b*, so that coils are simultaneously energized only for the actuators 15*b*, 17*b*, and therefore the respective switch pins only of the actuators 15*b*, 17*b* are simultaneously extended. Coils of the actuators 20*b*, 22*b*, which are provided for providing the opposite switching direction 21*b*, remain de-energized. The switch pins of the actuators 15*b*, 17*b*, which are associated with the desired switching direction 16*b*, simultaneously engage with a corresponding gate track 31*b*, 33*b*, so that the actuator 15*b* and the actuator 17*b* are in operative connection with the switch gate 10*b*, and the cam elements 12*b*, 13*b* are sequentially axially displaced in the switching direction 16*b* due to the rotary motion 11*b* of a camshaft 24*b*. If an electrical connection between the actuators 15*b*, 17*b* is defective or disconnected, the circuit between the actuators 15*b*, 17*b* connected in series is interrupted, so that these actuators are de-energized and therefore deactivated. The axial displacement, and thus the lift switching, in the switching direction 16*b* is therefore interrupted or stopped, so that incomplete lift switching may be prevented and a defined state may be associated with the cam elements 12*b*, 13*b*. The same analogously applies for an operating state in which the cam elements 12*b*, 13*b* are to be axially displaced for lift switching in the switching direction 21*b*.

In principle, all actuators 15*b*, 17*b*, 20*b*, 22*b* which are provided for providing the two switching directions 16*b*, 21*b* may be electrically connected to one another in series. With reference to the above-described exemplary embodiment according to FIG. 2, the first actuator 15*b*, the second actuator 17*b*, the third actuator 20*b*, and the fourth actuator 22*b* would then be electrically connected to one another in series, regardless of which switching direction 16*b*, 21*b* they are provided for. The coils of all actuators 15*b*, 17*b*, 20*b*, 22*b* are connected in series. The actuators 15*b*, 17*b* are electrically independent from the actuators 20*b*, 22*b*. A circuit for controlling the actuators 15*b*, 17*b*, 20*b*, 22*b* is closed only when all electrical connections between the actuators 15*b*, 17*b*, 20*b*, 22*b* and the control and regulation unit 18*b* are functional. Thus, controlling the actuators 15*b*, 17*b*, 20*b*, 22*b* is possible only when all electrical connections between the actuators 15*b*, 17*b*, 20*b*, 22*b* and the control and regulation unit 18*b* are functional. Controlling only one, two, or three actuators 15*b*, 17*b*, 20*b*, 22*b* is not possible. Either only all actuators 15*b*, 17*b*, 20*b*, 22*b* may be jointly controlled, or none of the actuators 15*b*, 17*b*, 20*b*, 22*b* may be controlled. For axially displacing the cam elements 12*b*, 13*b*, the control and regulation unit 18*b* always simultaneously controls all actuators 15*b*, 17*b*, 20*b*, 22*b*, regardless of the switching direction 16*b*, 21*b*. For this purpose, the control and regulation unit 18*b* has a single output stage which is simultaneously connected to the first actuator 15*b*, to the second actuator 17*b*, to the third actuator 20*b*, and to the fourth actuator 22*b*. The control and regulation unit 18*b* thus has one output stage for both switching directions 16*b*, 21*b*.

What is claimed is:

1. An internal combustion engine valve drive device for a motor vehicle, having at least one camshaft (24*a*, 24*b*) which includes at least first and second cam elements (12*a*, 13*a*, 12*b*, 13*b*) with gate tracks (31*a*, 32*a*, 33*a*, 34*a*, 31*b*, 32*b*, 33*b*, 34*b*) for lift switching of valves of the internal combustion engine by converting a rotary motion (11*a*; 11*b*) of the cam elements (12*a*, 13*a*; 12*b*, 13*b*) into an axial motion (14*a*; 14*b*), each cam element (12*a*, 13*a*; 12*b*, 13*b*) being provided with a first actuator (15*a*, 17*a*; 15*b*, 17*b*) for axially displacing the first cam element (12*a*, 12*b*; 13*a*, 13*b*) in one switching direction (16*a*; 16*b*), and a second actuator (20*a*, 22*a*; 20*b*, 22*b*) for axially displacing a second cam element (13*a*; 13*b*) in an opposite switching direction (21*a*, 21*b*), and a control unit (18*a*; 18*b*) for controlling an axial displacement of the first and second cam elements (12*a*, 13*a*; 12*b*, 13*b*) in the said one switching direction (16*a*; 16*b*), the control unit (18*a*; 18*b*) being provided for simultaneously initiating an axial displacement of the first actuators (15*a*, 17*a*; 15*b*, 17*b*) and an axial displacement of the second actuators (20*a*, 22*a*, 20*b*, 22*b*).

2. The internal combustion engine valve drive device according to claim 1, wherein at least the first actuator (15*a*; 15*b*) and the second actuator (17*a*; 17*b*) are electrically connected to one another in one of a parallel and a serial circuit arrangement for common energization of the actuators of the at least first and, respectively, second cam elements (12*a*, 13*a*, 12*b*, 13*b*).

3. The internal combustion engine valve drive device according to claim 1, wherein the control unit (18*a*; 18*b*) has a control output stage (19*a*; 19*b*) which is simultaneously connected to the at least first and second actuators (15*a*, 17*a*; 15*b*; 17*b*), which are provided for axially displacing the at least two cam elements (12*a*, 13*a*; 12*b*, 13*b*) in the same switching direction (16*a*; 16*b*).

4. The internal combustion engine valve drive device according to claim 3, wherein for axially displacing the at least first and second cam elements (12*a*, 13*a*), the control unit (18*a*) is provided for simultaneously controlling and/or monitoring, regardless of a switching direction (16*a*, 21*a*) of the at least first and second actuators (15*a*, 17*a*), the at least first and second actuators (15*a*, 17*a*) and at least a third actuator (20*a*), which is provided for axially displacing the first cam element (12*a*) and the second cam element (13*a*) in a switching direction (21*a*) oriented opposite the switching direction (16*a*) provided by the first actuator (15*a*) and the second actuator (17*a*), via an operative connection with the switch gate (10*a*).

5. The internal combustion engine valve drive device according to claim 1, wherein the valve drive device includes at least a third actuator (20*a*) which is electrically connected in one of a parallel and a series circuit arrangement to the first actuator (15*a*) and the second actuator (17*a*).

6. The internal combustion engine valve drive device according to claim 4, wherein the control output stage (19*a*) is simultaneously connected to the at least two respective actuators (15*a*, 17*a*, and, respectively, 20*a*, 22*a*), which are provided for axially displacing the at least two cam elements (12*a*, 13*a*) in oppositely oriented switching directions (16*a*, 21*a*).

7. The internal combustion engine valve drive device according to claim 1, wherein a third actuator (20*b*) and a fourth actuator (22*b*) which are connected electrically separate from the first actuator (15*b*) and the second actuator (17*b*) and which are provided liar axially displacing the first cam element (12*b*) and the second cam element (13*b*) in a switching direction opposite to the switching direction (16*b*) provided by the first actuator (15*b*) and the second actuator (17*b*).

8. The internal combustion engine valve drive device according to claim 7, wherein the fourth actuator (22*b*), which is electrically connected in a parallel or in a serial circuit with the third actuator (20*b*), is provided for axially displacing the first cam element (12*b*) or the second cam element (13*b*) in the switching direction (21*b*) which corresponds to the switching direction (21*b*) provided by the third actuator (20*b*), via an operative connection with the switch gate (10*b*).

9. The internal combustion engine valve drive device according to claim 7, wherein the control unit (18*b*) has a further control and output stage (23*b*) which is connected al least to the third actuator (20*b*) and the fourth actuator (22*b*).

10. A method for valve lift switching in an internal combustion engine of a motor vehicle by means of an internal combustion engine valve drive device according to claim 1, comprising the steps of displacing the first cam element (12*a*; 12*b*) axially in a switching direction (16*a*; 16*b*) by means of an operative connection of a first actuator (15*a*; 15*b*) with a switch gate (10*a*; 10*b*), and displacing a second cam element (13*a*; 13*b*) axially in the same switching direction (16*a*; 10*b*) by means of an operative connection of a second actuator (17*a*; 17*b*) with the switch gate (10*a*; 10*b*), and simultaneously controlling the first actuator (15*a*; 15*b*) and the second actuator (17*a*; 17*b*) for axially sequentially displacing the first and second cam elements (12*a*, 13*a*; 12*b*, 13*b*) one after the other.

* * * * *